United States Patent [19]

Jordan

[11] 4,253,009

[45] Feb. 24, 1981

[54] HEATING ELEMENT FOR WATER HEATER

[76] Inventor: Chalmer C. Jordan, Perry Hwy., Saegertown, Pa. 16433

[21] Appl. No.: 25,785

[22] Filed: Apr. 2, 1979

[51] Int. Cl.[3] ..... F24H 1/20

[52] U.S. Cl. ..... 219/336; 338/229; 338/315; 219/318; 219/523; 219/536

[58] Field of Search ..... 219/208, 318, 335, 336, 219/451, 523, 536, 537, 357, 542; 81/10, 3; 211/26, 13; 29/611; 338/228–230, 315

[56] References Cited

U.S. PATENT DOCUMENTS

| | | | |
|---|---|---|---|
| 3,217,138 | 11/1965 | Drugmand | 219/336 |
| 3,798,749 | 3/1974 | Duer | 81/10 X |
| 3,943,328 | 3/1976 | Cunningham | 219/335 |
| 3,992,608 | 11/1976 | Snavely | 219/336 |
| 4,152,578 | 5/1979 | Jacobs | 219/336 |

FOREIGN PATENT DOCUMENTS

| | | | |
|---|---|---|---|
| 1088250 | 10/1967 | United Kingdom | 219/336 |
| 1278121 | 6/1972 | United Kingdom | 219/336 |

*Primary Examiner*—Volodymy Y. Mayewsky
*Attorney, Agent, or Firm*—Charles L. Lovercheck

[57] ABSTRACT

A mounting for a heating element on a hot water tank wherein an externally threaded spud is welded to the tank around an opening and the heating element is pushed through the opening, the heating element having a mounting plug thereon with a gasket to engage the spud and a nut having a wave spreading flange engages the mounting plug threadably engages the spud holding a sealing element on the mounting plate against the spud to prevent leakage.

1 Claim, 5 Drawing Figures

HEATING ELEMENT FOR WATER HEATER

GENERAL DESCRIPTION OF THE INVENTION

A mounting for an electrical heating element for hot water tank is shown. The conventional heating element for hot water heaters is held in place by a threaded hex plug fixed to the electrical plug and threaded into a threaded opening in the hot water tank. Other tanks use a plate fixed to the electrical connector clamped to the tank with a suitable bracket. These prior plug threads were exposed to water and usually corroded. The plates that were fixed to the tank were not internally protected from the water in the tank and they rusted and leaked. Both of the above were difficult to repair after extended use and the cost of production of these prior mountings were considerable. The mounting according to this invention is made by providing a flange on a support for the mounting plug which rests on a resilient seal supported on the tank. A ring with an internal flange rests on the plug and forces the flange on the plug against the seating surface on the tank providing a seal. The flange can have an integral serrated spring flange to provide resiliency and the seal can be supported by a ring having internal threads, bayonet type connectors, aircraft type locks, studs or other suitable well known connectors may be used.

OBJECTS OF THE INVENTION

It is an object of the invention to provide an improved mounting for an electrical heater for a water heating tank.

Another object of the invention is to provide an improved combination water tank and heater element mounted thereon.

Another object of the invention is to provide a heating element mounting for a water tank that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
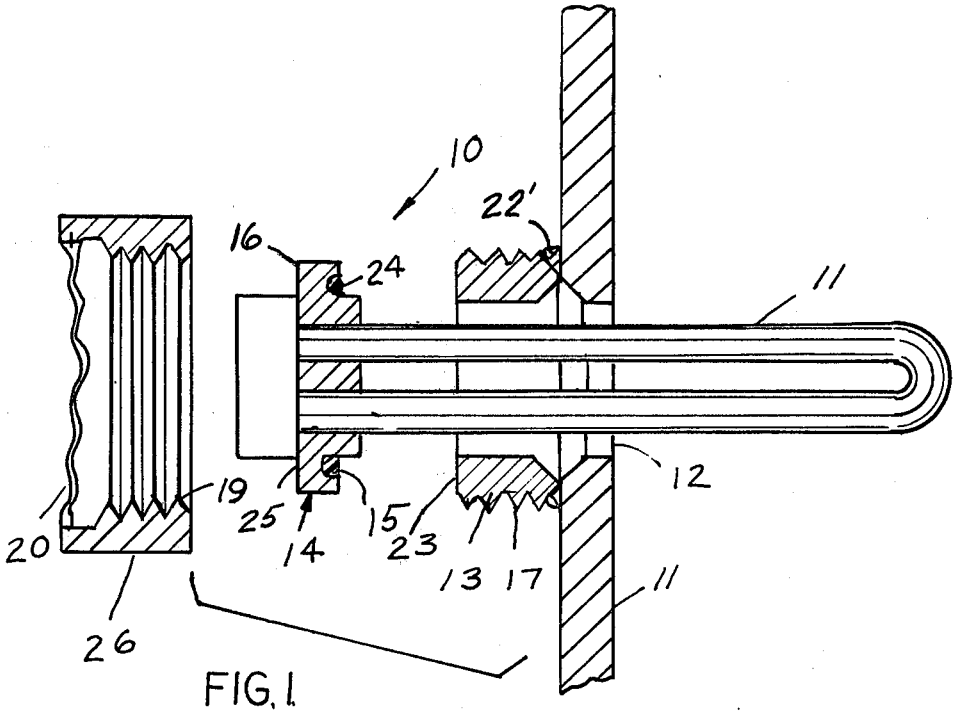
FIG. 1 is an exploded view of the heater element mounting according to the invention.
Figure 2:
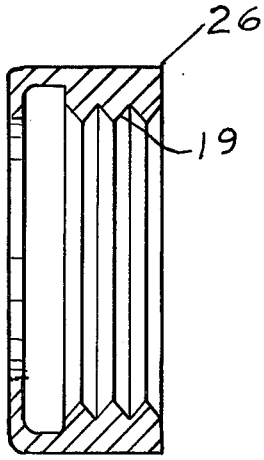
FIG. 2 is a thread ring for mounting the heating element of FIG. 1.
Figure 3:
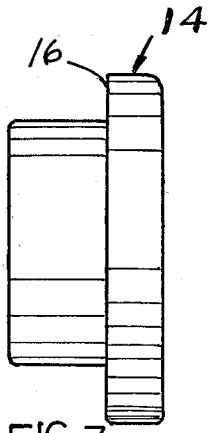
FIG. 3 is a heater support of FIG. 2 to a different scale than FIG. 4.
Figure 5:
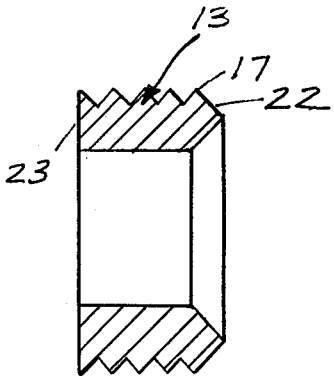
FIG. 5 is a spud for an electric water heater mounting shown in FIG. 1.
Figure 4:
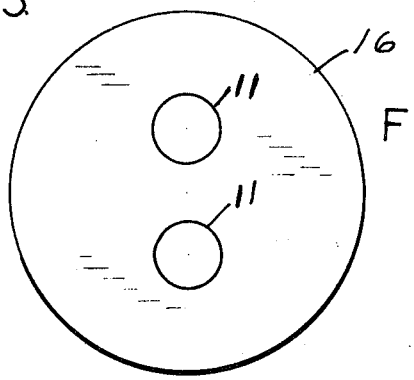
FIG. 4 is a front view of the heater support shown in FIG. 1.

Now, with more particular reference to the drawing, the heater and mounting is shown generally in FIG. 1 at

10 with the hot water tank 11 shown broken away with the opening 12 therein, the heater 10 is thrust through the opening 12 and the bushing 13 is welded to the tank around the opening, the bushing 13 being welded at 22' around the tapered end 22.

The heater 11 is of a type familiar to those skilled in the art of the type manufactured by General Electric Company under the name Calrod having a shield isolated from the heating element therein like the heater shown in U.S. Pat. No. 3,217,138 and having a dielectric terminal support on the outer end.

The bushing 13 has external thread 17 and a flat shoulder 23 on the outer end. The mounting plug 14 has a peripheral groove 24 in its inner side that receives the sealing washer 15, and the flange 16 has a flat outer surface 25 thereon which engages the serrated spring flange 20 on the ring 26. Ring 26 has internal threads 19 that engage external threads 17 on the bushing 13 and the sealing washer 15 engages the shoulder 23 forming a seal. The spring flange 20 provides resiliency to prevent crushing the seal 15 yet it provides a sufficient force thereon. It will be noted that the water inside the tank is prevented from engaging the threads 17 and 19 by the seal 15 thereby preventing rust and corrosion and the external threads being protected from the water will have an extended life.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a hot water tank (11') and a Galrod type electric heater (11), a mounting (10) for supporting said heater on said tank, said mounting comprising a bushing (13) adapted to be welded to said tank around an opening (12) in said tank, said bushing (13) having a generally flat surface (23) extending generally parallel to the side of said tank (11'), a mounting plug (14), said mounting plug (14) having a radially extending flange (16) thereon and having said electric heater supported on the inner side thereon, a mounting ring (26) having internal threads (19) threadably engaging external threads on bushing (13), said mounting ring having an inwardly directed flange 20 thread engaging said flange on said mounting plug, said mounting ring inwardly directed flange (20) being in the form of a wavy spring member resiliently engaging a said radially extending flange on said mounting plug (14), a sealing resilient washer (15) on the innerside of said mounting plug (14) engaging said outer end of said bushing preventing leakage between said bushing and said mounting flange to said thread said mounting plug having a groove (24) on the side thereof adjacent said plug, and said sealing resilient washer (15) in said groove.

* * * * *